US005695095A

United States Patent [19]

Hildebrand

[11] Patent Number: 5,695,095

[45] Date of Patent: Dec. 9, 1997

[54] WIDE ERGONOMIC TRIGGER FOR A TRIGGER SPRAYER

[75] Inventor: George Hildebrand, O'Fallon, Mo.

[73] Assignee: Contico International, Inc., St. Louis, Mo.

[21] Appl. No.: 560,467

[22] Filed: Nov. 17, 1995

Related U.S. Application Data

[63] Continuation-in-part of Ser. No. 43,775, Sep. 12, 1995, Pat. No. Des. 376,318.

[51] Int. Cl.[6] ..... B67D 5/40

[52] U.S. Cl. ..... 222/383.1; 239/333

[58] Field of Search ..... 222/383.1, 474, 222/323; 239/412, 333

[56] References Cited

U.S. PATENT DOCUMENTS

| | | | |
|---|---|---|---|
| D. 44,414 | 7/1913 | Schaefer | D8/88 |
| D. 333,616 | 3/1993 | Perkins | D9/448 |
| 2,879,925 | 3/1959 | Remane | 222/402.15 |
| 3,112,849 | 12/1963 | Wallace | 222/323 |
| 3,209,949 | 10/1965 | Gurtler | 222/49 |
| 4,157,774 | 6/1979 | Micallef | 222/402.15 |
| 4,826,052 | 5/1989 | Micallef | 222/383.1 |
| 5,172,836 | 12/1992 | Warner | 222/383.1 |
| 5,207,359 | 5/1993 | Steijns | 222/383.1 |
| 5,318,492 | 6/1994 | Quinn | 482/108 |
| 5,332,159 | 7/1994 | Grime et al. | 239/412 |
| 5,439,178 | 8/1995 | Peterson | 222/383.1 |
| 5,507,437 | 4/1996 | Foster et al. | 239/333 |

*Primary Examiner*—Gregory L. Huson
*Attorney, Agent, or Firm*—Howell & Haferkamp, L.C.

[57] ABSTRACT

A trigger sprayer apparatus comprises a trigger for manipulation by a user of the apparatus to dispense a spray, stream or foam of a liquid from the apparatus, the trigger having finger engagement areas across the front surface of the trigger that increase in size as the trigger extends from its attachment to the trigger sprayer to a distal end of the trigger.

20 Claims, 4 Drawing Sheets

WIDE ERGONOMIC TRIGGER FOR A TRIGGER SPRAYER

This application is a continuation-in-part application of Design Patent U.S. Ser. No. 29/043,775, now U.S. Pat. No. Des. 376,318, issued Dec. 10, 1996 filed Sep. 12, 1995, and titled "Wide Ergonomic Trigger for a Trigger Sprayer".

BACKGROUND OF THE INVENTION (1) Field of Invention

The present application pertains to a trigger sprayer apparatus of the type comprising a trigger for manipulation by a user of the apparatus to dispense a spray, stream or foam of a liquid from the apparatus. In particular, the present invention pertains to an ergonomic trigger for such a trigger sprayer having finger engagement areas across the front surface of the trigger that increase in size as the trigger extends from its attachment to the trigger sprayer to a distal end of the trigger.

(2) Description of the Related Art

In prior art trigger sprayer apparatus employed in dispensing liquid from containers, the typical sprayer apparatus is comprised of a sprayer housing having a nozzle for dispensing liquid, a trigger mounted on the housing for pivoting movement relative thereto, a pump chamber formed in the housing, and a pump piston connected to the trigger and received in the pump chamber for reciprocating movement therein in response to pivoting movement of the trigger. The reciprocating movement of the pump piston alternately draws liquid from the container into the pump chamber, and then forces the liquid out of the pump chamber and through the nozzle in a spray, stream or foam pattern.

Trigger mechanisms of prior art sprayer assemblies are typically provided with a pair of laterally spaced flanges at their upper ends that are inserted around opposite lateral sides of a fluid dispensing nozzle attached to the sprayer housing of the apparatus. The flanges are also inserted between extensions of the sprayer housing positioned adjacent the opposite lateral sides of the fluid dispensing nozzle. The flanges are provided with pivot pins on their exterior surfaces that are received in sockets in the extensions of the sprayer housing. The insertion of the pivot pins in the sockets provides a pivoting connection of the trigger member to the sprayer housing.

The typical trigger of the prior art also includes a shank portion that extends longitudinally downwardly from the laterally spaced flanges at the upper end of the trigger to a distal end of the shank portion at the lower end of the trigger. The shank portion has a front surface that faces away from the sprayer housing of the sprayer apparatus, and a rear surface that is operatively engaged with the pump piston of the sprayer apparatus. The front surface of the shank serves as the finger engagement surface of the trigger. The fingers of a user's hand engage across this surface when manipulating the trigger to operate the pump.

The lateral width of the shank position engagement surface is usually equal to or smaller than the lateral spacing between the flanges of the trigger mechanism for the entire longitudinal length of the shank portion. In some prior art trigger mechanisms, the lateral width is initially equal to the lateral spacing between the trigger flanges and decreases in size as the shank portion extends from the flanges to its distal end, thereby conserving the amount of plastic needed to mold the trigger mechanism.

Very often the principal consideration in the design of prior art trigger mechanisms is the costs involved in manufacturing the mechanisms. Prior art trigger mechanisms are frequently designed with configurations that are easy to mold from plastic and provide the required structural strength from the minimum amount of plastic needed to construct the trigger mechanism. These prior art trigger mechanisms have been found to be disadvantaged in that the designs do not take into consideration the comfort of the user's hand. The user's comfort is easily overlooked because the typical usage of a trigger sprayer apparatus requires reciprocating the pump piston only once or twice to initially prime the pump, and then once or twice more to dispense a desired amount of liquid from the sprayer apparatus. The comfort of the user's hand was likely not considered in the design of the engagement surfaces of prior art sprayer triggers because they were not seen as being manipulated a significant number of times by the user's hand in each use of the sprayer apparatus. However, it has since been recognized that the configurations of engagement surfaces of prior art trigger mechanisms cause discomfort to and fatigue the fingers of a user's hand following any appreciable prolonged use of the sprayer apparatus.

SUMMARY OF THE INVENTION

The present invention overcomes the aforesaid disadvantages typically associated with prior art trigger mechanisms by providing an improved trigger mechanism having an ergonomic engagement surface that reduces the discomfort and fatigue of the fingers of the user's hand during prolonged use of the sprayer apparatus. As in the prior art trigger mechanisms, the ergonomic trigger of the invention is provided with a pair of laterally spaced flanges at its upper end that are inserted around opposite lateral sides of a fluid dispensing nozzle attached to the sprayer housing of the sprayer apparatus. The flanges are also inserted between extensions of the sprayer housing positioned adjacent the opposite lateral sides of the nozzle. The flanges have pivot pins on their exterior surfaces that are received in sockets in the sprayer housing extensions, thereby mounting the trigger for pivoting movement relative to the sprayer housing.

The trigger is provided with a shank portion that extends downwardly from the pair of laterally spaced flanges to a distal end of the shank. The shank portion has opposite front and rear surfaces. Laterally spaced side edges separate the front and rear surfaces and extend the longitudinal length of the trigger shank between the flanges at the trigger upper end and the distal end of the trigger shank. The front surface of the trigger shank serves as the engagement surface for the fingers of a user's hand, and the rear surface of the trigger shank is operatively connected to the pump piston of the sprayer apparatus.

The improvement to the trigger mechanism of the invention is provided in the ergonomic configuration of the shank engagement surface. As the shank engagement surface extends longitudinally downwardly from the flanges at the trigger upper end toward the shank distal end, the lateral width of the engagement surface increases. This configuration of the shank front surface provides engagement areas for each of the fingers of the user's hand that increase in size as the shank extends downwardly toward its distal end. The increased area of the engagement surface distributes the force exerted against the fingers of the user's hand during manipulation of the trigger over a greater area of the user's fingers, thereby appreciably decreasing the discomfort caused to the user's fingers during prolonged manipulation of the trigger. Furthermore, by the engagement surface configurations distributing the force of trigger manipulation over a greater area of the user's fingers, the fatigue caused to the user's hand from prolonged manipulation of the trigger is substantially reduced.

BRIEF DESCRIPTION OF THE DRAWING FIGURES

Further objects and features of the present invention are revealed in the following detailed description of the preferred embodiment of the invention and in the drawing figures wherein.

DESCRIPTION OF THE PREFERRED EMBODIMENT

The ergonomic trigger of the present invention is employed on a trigger sprayer apparatus 10 of the type disclosed in U.S. Pat. No. 5,344,053. However, it should be understood that the ergonomic trigger of the invention may be employed with various different types of manually operated trigger sprayer apparatus and various different types of manually operated apparatus employing a trigger. Although the trigger of the invention is described as being employed with one particular type of trigger sprayer apparatus, it should be understood that this explanation of the trigger of the invention is illustrative only and should not be interpreted as limiting the trigger for use with only one particular type of apparatus.

Figure 1:
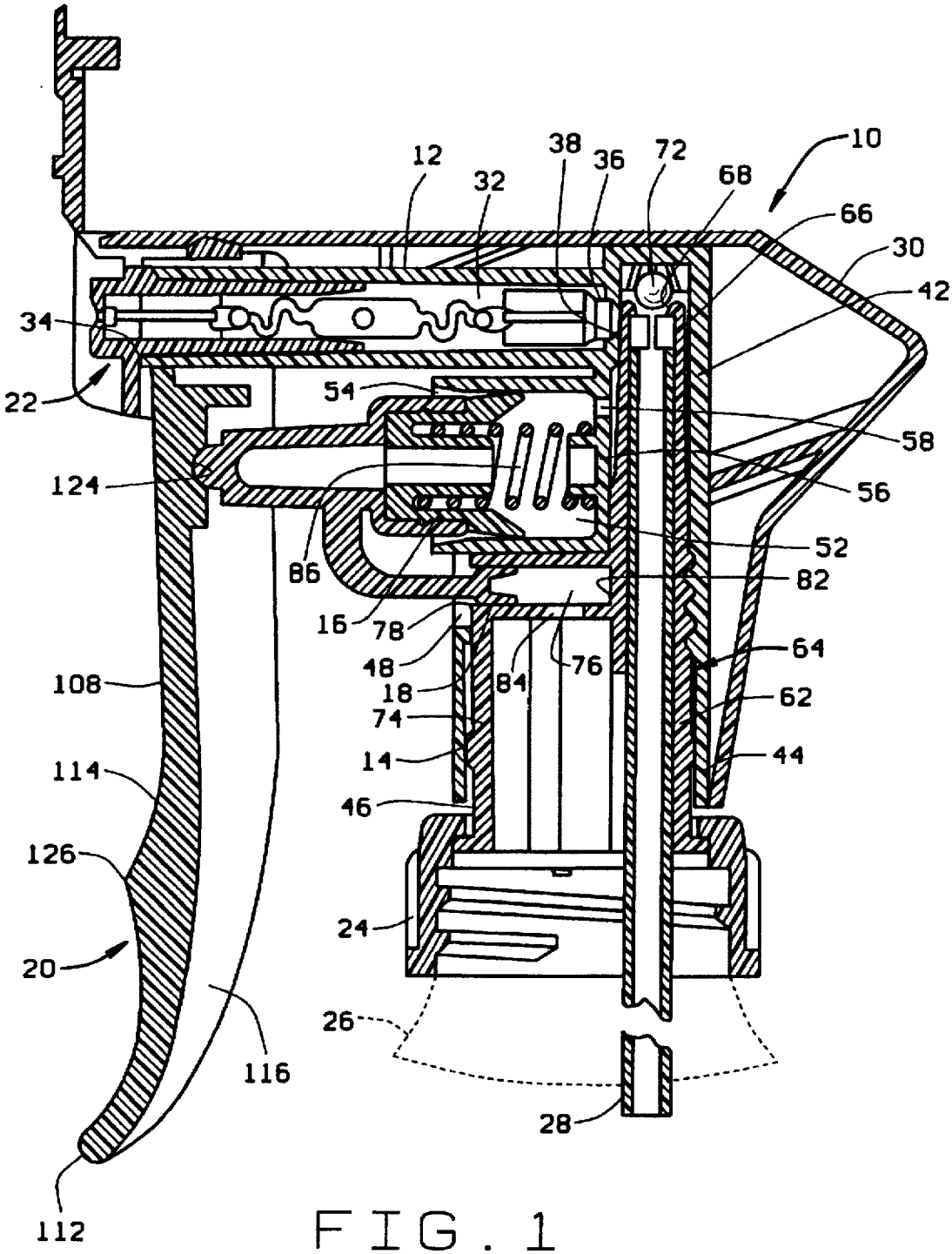
FIG. 1 is a side elevation view, in section, of a trigger sprayer apparatus with the trigger of the invention attached.
Figure 2:
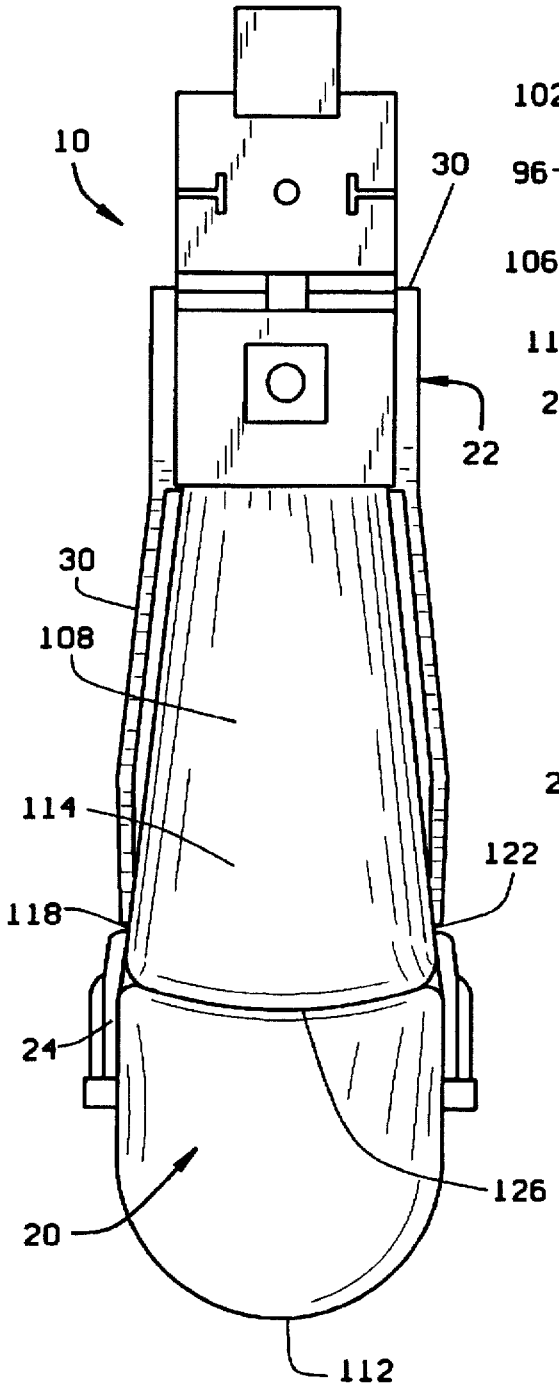
FIG. 2 is a front elevation view of the trigger sprayer apparatus of FIG. 1.

The ergonomic trigger of the present invention is shown in FIGS. 1 and 2 employed on a trigger sprayer apparatus 10 generally comprised of a sprayer housing 12, a vent housing 14, a pump piston 16 and interconnected vent piston 18, the trigger member 20 of the invention, a nozzle assembly 22, an internally threaded connector 24 that connects the sprayer apparatus 10 to a fluid container 26, and a fluid supply tube 28 that extends from the sprayer apparatus 10 down into the interior volume of the container 26. As is commonly employed in trigger sprayer apparatus, an ornamental shroud 30 covers over the sprayer housing 12 and vent housing 14. Several component parts of the trigger sprayer apparatus 10 listed above are conventional and will not be described in detail for simplicity, with the detailed descriptions being directed to the improvements of the trigger member 20 of the invention.

The sprayer housing 12 is molded of a plastic type material and includes several separate interior chambers connected in communication with each other. Positioned toward the top of the sprayer housing 12 is a fluid discharge channel 32. The channel 32 has a cylindrical interior surface with an opening 32 at its forward end, or left hand end as viewed in FIG. 1, for receiving the nozzle assembly 22. An end wall 36 closes off the opposite right hand end of the channel 32 and a valve seat 38 is formed at the center of the end wall. The valve seat 38 seats a valve head of a fluid spinner assembly.

The valve seat 38 communicates the interior of the discharge channel 32 with the interior of a hollow fluid supply column 42 of the sprayer housing 12. The fluid supply column 42 extends vertically downwardly from the top of the sprayer housing 12 along the rear of the housing to a cylindrical vent housing chamber 44 provided at the bottom of the sprayer housing. An opening 46 at the bottom of the vent housing chamber 44 receives the vent housing 14 of the sprayer apparatus. An additional opening 48 is provided through a forward portion of the vent housing chamber sidewall at the top of the vent housing chamber to accommodate the vent piston 18.

A cylindrical pump chamber 52 is formed in the sprayer housing 12 between the fluid discharge channel 32 and the vent housing chamber 44. The pump chamber 52 is positioned just forward of the fluid supply column 42. The pump chamber 52 has an opening 54 at its forward end through which the pump piston 16 extends. An end wall 56 opposite the opening 54 closes off the rearward end of the pump chamber. A fluid channel 58 extends through the pump housing end wall 56 and communicates the interior volume of the pump chamber with the interior of the fluid supply column 42 at the rear of the sprayer housing 12.

The vent housing 14 has a vertically extending fluid conducting column 62 that is inserted into the interior of the fluid supply column 42 of the sprayer housing 12. The circumference of the vent housing column 62 at the upper end of the column is reduced to provide a fluid conducting channel 66 between the exterior of the vent housing column 62 and the interior of the sprayer housing column 42. The channel 66 communicates the pump chamber fluid channel 58 with the fluid discharge channel 32.

A check valve seat 68 is formed at the top end of the vent housing column 62 and a ball check valve 72 is provided on the valve seat. The check valve 72 controls the direction of liquid flow through the vent housing column, permitting liquid to flow out of the vent housing column 62 through the check valve seat 68, and preventing the flow of liquid back through the vent housing column through the check valve seat. The supply dip tube 28 is secured in the interior of the vent housing column 62 and extends downwardly from the vent housing column into the interior of the fluid container 26 connected to the sprayer apparatus.

A base 74 of the vent housing is formed integrally with the vent housing column 62. A cylindrical vent chamber 76 is formed extending transversely into the top of the vent housing base 74. The vent chamber 76 has an opened forward end 78 and a closed rearward end 82. The vent chamber opening 78 at the forward end, or left hand end as viewed in FIG. 1, is aligned with the vent chamber opening 48 of the sprayer housing 12. A vent opening 84 passes through the bottom of the vent chamber sidewall. The opening 84 communicates the interior of the vent chamber with the interior of the vent housing base and also the interior of the fluid container 26 connected to the sprayer apparatus.

The trigger member 20 of the invention is operated in the same manner as conventional triggers. The trigger member is engaged by the fingers of a user's hand to pivot the trigger member relative to the sprayer housing 12 and thereby pump fluid from the sprayer by reciprocation of the pump and vent pistons 16, 18 in their respective chambers. A coiled spring 86 in the pump chamber 52 returns the pump and vent pistons 16, 18 and the trigger member 20 to their at rest positions shown in FIG. 1. The operation of the pump piston 16 in dispensing liquid from the apparatus is conventional.

Figure 4:
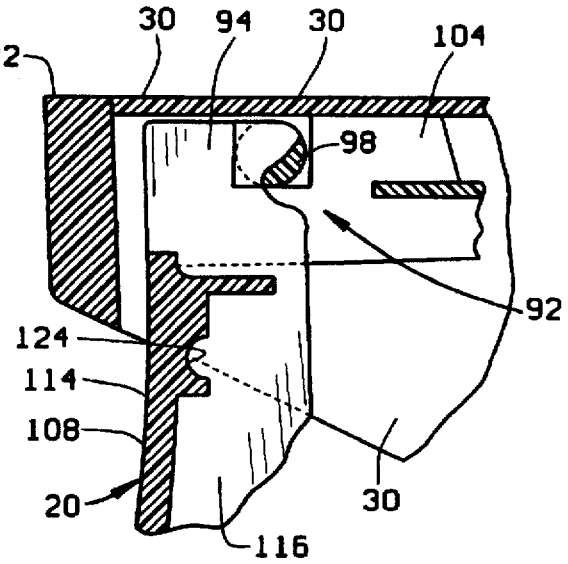
FIG. 4 is a partial view, in section, of the trigger member taken along the line 4—4 of FIG. 3.
Figure 5:
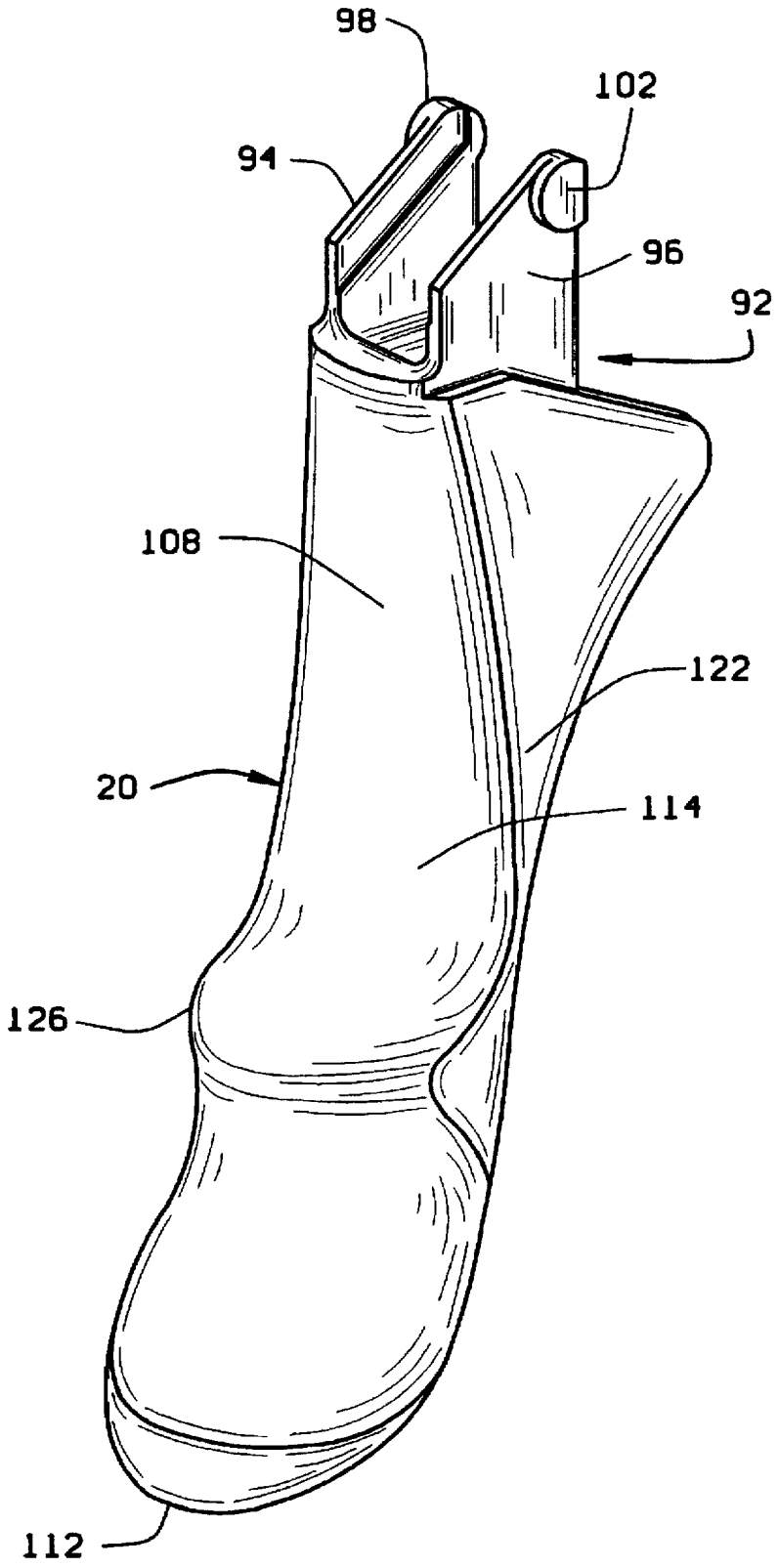
FIG. 5 is a perspective view of the trigger mechanism of the present invention removed from the sprayer.
Figure 6:
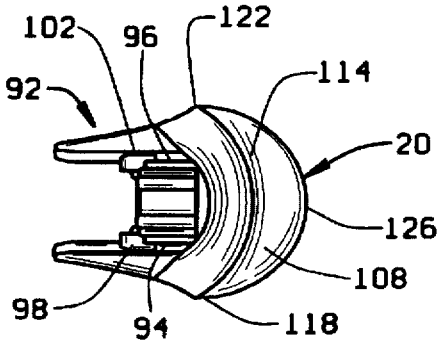
FIG. 6 is a top plan view of the trigger.
Figure 7:
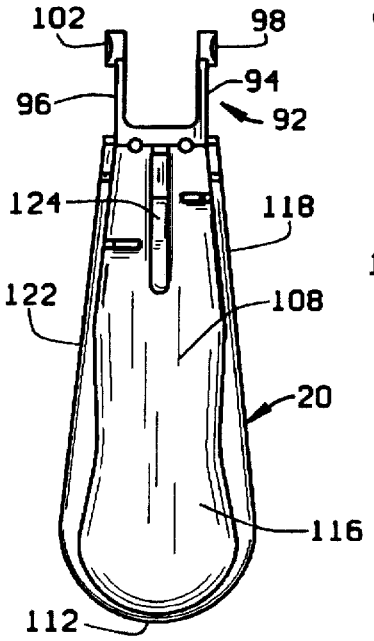
FIG. 7 is a rear elevation view of the trigger.
Figure 8:
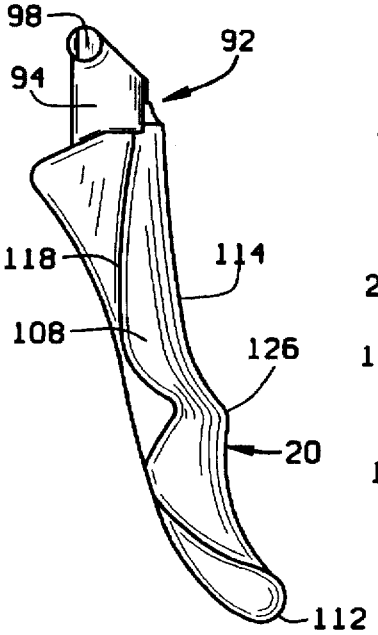
FIG. 8 is a left side elevation view of the trigger.
Figure 9:
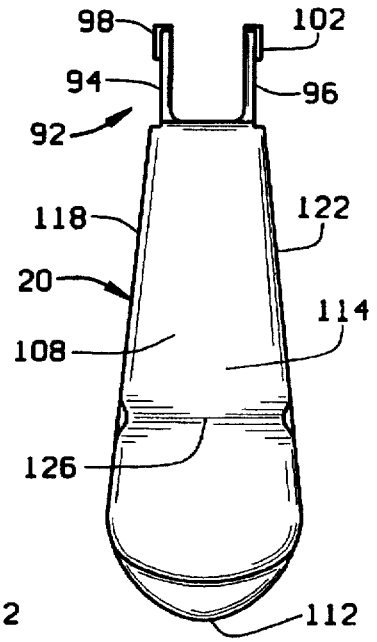
FIG. 9 is a front elevation view of the trigger.
Figure 10:
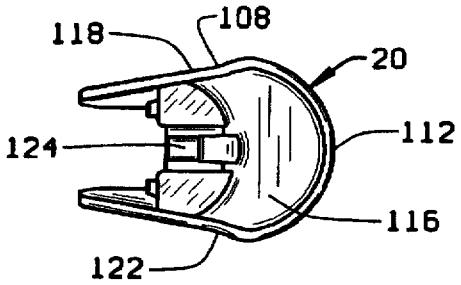
FIG. 10 is a bottom plan view of the trigger.

The upper end 92, or proximal end, of the trigger member 20 has a pair of laterally spaced flanges 94, 96 formed thereon. The flanges extend upwardly around the opposite lateral sides of the sprayer housing fluid discharge channel 32. The lateral spacing between the flanges provides ample clearance between the mutually opposed interior surfaces of the flanges and the opposite lateral sides of the fluid discharge channel 32 and nozzle assembly 22. Each of the flanges 94, 96 has a pivot post or pin 98, 102 formed on its exterior surface. The pivot pins are formed coaxially with each other and at a rearward corner of the flanges as seen in FIG. 4. Each of the pivot pins 98, 102 engages in a socket formed in the extensions 104, 106 of the sprayer housing 12 projecting over the opposite exterior surfaces of the flanges 94, 96. The engagement of the pivot pins 98, 104 in the sockets of the sprayer housing extensions 104, 106 provides the pivoting connection of the trigger member 20 to the sprayer housing.

Figure 3:
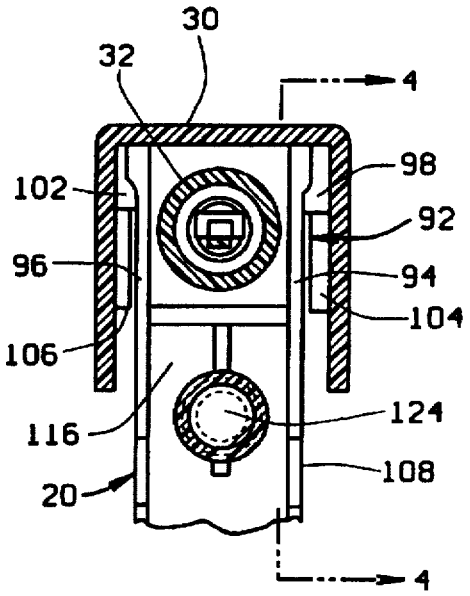
FIG. 3 is a partial view, in section, of the trigger member taken along the line 3—3 of FIG. 1.

The extensions 104, 106 of the sprayer housing are formed of the plastic material employed in constructing the sprayer housing and therefore have a resiliency. This resiliency permits the extensions to be deformed away from each other while inserting the trigger member flanges 94, 96 between the extensions and around the fluid discharge channel 32 of the sprayer housing. When the trigger member is positioned relative to the sprayer housing extensions 104, 106 so that the pivot pins 98, 102 are positioned in the sockets of the extensions, the resiliency of the sprayer housing extensions 104, 106 causes the extensions to return to their at rest configuration shown in FIG. 3 and retain the trigger member in its pivoting connection to the sprayer housing.

The trigger member has a longitudinally elongated shank portion 108 that extends downwardly from the pair of laterally spaced flanges 94, 96 to a distal end 112 of the shank. The shank portion 108 has opposite front 114 and rear 116 surfaces. Laterally spaced side edges 118, 122 extend downwardly along the longitudinal length of the shank from the flanges 94, 96 at the trigger upper end to the distal end 112 of the shank. The laterally spaced side edges 118, 122 extend between and separate the front and rear surfaces 114, 116 of the shank.

The shank rear surface 116 is provided with a journal recess 124 that engages with the piston 16 of the sprayer and provides the operative connection between the trigger member and the piston. This operative engagement provided by the journal recess 124 is only one type of possible mechanical connection between the trigger member 20 and the pump piston 16. It should be understood that various different types of operative connections may be provided between the trigger member 20 of the invention and the pump piston of the particular trigger sprayer apparatus with which the trigger member of the invention is used. Therefore, although the journal recess 124 is shown as the type of operative connection employed in this particular illustrative embodiment, various different types of mechanical connections may be employed on the trigger member 20 of the invention connecting it to a pump mechanism.

The front surface 14 of the trigger shank serves as the engagement surface for the fingers of a user's hand operating the trigger sprayer apparatus. The improvement to the trigger mechanism 20 of the invention is provided in the ergonomic configuration of the shank front engagement surface 114. The front engagement surface is comprised of a plurality of engagement areas that are configured to engage with the individual fingers of the user's hand. The trigger shown has two engagement areas shown separated by a crest 126 that extends laterally across the trigger and separates the engagement areas. The crest comfortably fits between the fingers of a user's hand and prevents the user's fingers from slipping downwardly off the trigger during use. Although one crest is shown, two may be employed separating three engagement areas on the trigger. The engagement areas are spacially arranged over the front surface and increase in size as the shank engagement surface 114 extends longitudinally downwardly from the flanges at the trigger upper end toward the shank distal end. As the shank extends downwardly from its upper end toward its bottom end, the lateral width of the engagement surface 114 between the side edges 118, 122 also increases. As best seen in FIG. 2, the lateral width of the shank is smallest at the top of the shank where it merges into the pair of laterally spaced flanges 94, 96. As the engagement surface 114 extends downwardly from the flanges, its lateral width gradually increases as it approaches the shank distal end 112. Adjacent to the shank distal end 112 the opposite lateral side edges 118, 122 begin to curve toward each other and meet at the shank distal end.

The increased area of the shank engagement surface 114 distributes the force exerted against the fingers of the user's hand during manipulation of the trigger over a greater area of the user's fingers, thereby appreciably decreasing the discomfort caused to the user's fingers during prolonged manipulation of the trigger. By the engagement surface configurations distributing the force of trigger manipulation over a greater area of the user's fingers, the fatigue caused to the user's hand from prolonged manipulation of the trigger is substantially reduced.

While the present invention has been described by reference to a specific embodiment, it should be understood that modifications and variations of the invention may be constructed without departing from the scope of the invention defined in the following claims.

What is claimed:

1. A trigger sprayer for dispensing liquid, said trigger comprising:

a housing;

a pump in the housing;

a fluid discharge passage in fluid communication with the pump;

a trigger operatively connected with the pump for operation of the pump on manual manipulation of trigger, the trigger having a shank having opposite top and bottom ends and opposite front and rear surfaces, a section of the rear surface being configured for engaging with the pump and the front surface being configured for engagement with at least one finger of a user's hand, the front surface having at least two finger engagement areas, the finger engagement area adjacent the shank top end being smaller than the finger engagement area adjacent the shank bottom end.

2. The trigger sprayer of claim 1, wherein:

the shank front surface has a plurality finger engagement areas sequentially arranged on the front surface between the shank top and bottom ends, and the engagement areas increase in size from the, top to the bottom of the shank.

3. The trigger sprayer of claim 1, wherein:

the shank has opposite side edges between the front and rear surfaces of the shank, the shank front surface has a plurality of widths between the side edges, and the widths increase in size as the shank front surface extends from the top to the bottom of the shank.

4. The trigger sprayer of claim 1, wherein:

the shank has opposite side edges between the front and rear surfaces of the shank, and the shank front surface has a convexed configuration between the side edges.

5. The trigger sprayer of claim 1, wherein:

the section of the shank rear surface is configured for engaging with the pump to cause movement of the pump between fluid charge and fluid discharge positions of the pump in response to manual movement of the trigger relative to the housing.

6. The trigger sprayer of claim 1, wherein:

the shank has a longitudinal length between its top and bottom ends and the shank has a first lateral width across the shank front surface adjacent the shank top end and a second lateral width across the shank front surface adjacent the shank bottom end, the first lateral width being smaller than the second lateral width.

7. The trigger sprayer of claim 6, wherein:

the shank has a connector at its top end configured for mounting the trigger to the housing for relative movement of the trigger to the housing, and the first and second lateral widths of the shank front surface are spaced longitudinally from the connector.

8. The trigger sprayer of claim 7, wherein:

the connector is configured for mounting the trigger to the housing for movement of the pump between fluid charge and fluid discharge positions of the pump on manual movement of the trigger relative to the housing.

9. A trigger sprayer for dispensing liquid, said trigger sprayer comprising;

a housing;

a pump in the housing;

a fluid discharge passage in the housing and in fluid communication with the pump;

a trigger operatively connected with the pump for operation of the pump on manual manipulation the trigger, the trigger having a shank with longitudinally opposite top and bottom ends, the top end having a connector configured for mounting the trigger to the housing for relative movement of the trigger to the housing, and the shank having a lateral width that is larger adjacent the shank bottom end than the lateral width adjacent the shank top end.

10. The trigger sprayer of claim 9, wherein:

the lateral width of the shank increases as the shank extends from the connector toward the shank bottom end.

11. The trigger sprayer of claim 9, wherein:

the shank has a front surface having a plurality of finger engagement areas spaced longitudinally over the front surface between the shank top and bottom ends, and at least one finger engagement area adjacent the shank bottom end is larger than at least one finger engagement area adjacent the shank top end.

12. The trigger sprayer of claim 9, wherein:

the shank has a front surface having a plurality of finger engagement areas spaced longitudinally over the front surface between the shank top and bottom ends, and the finger engagement areas progressively increase in size from the shank top end toward the shank bottom end.

13. The trigger sprayer of claim 9, wherein:

the connector is configured to mount the trigger to the housing for relative movement of the trigger toward and away from the housing.

14. The trigger sprayer of claim 13, wherein:

the shank has opposite front and rear surfaces, and a section of the rear surface is configured for engagement with the pump to cause movement of the pump between discharge and charge positions in response to movement of the trigger toward and away from the housing, respectively.

15. The trigger sprayer of claim 9, wherein:

the shank has opposite front and rear surfaces and laterally opposite side edges that extend between the top and bottom ends of the shank and separate the front and rear surfaces, and a lateral width between the side edges increases along at least a portion of the shank front surface as the shank extends from adjacent the top of the shank toward the bottom of the shank.

16. The trigger sprayer of claim 15, wherein:

at least a portion of the shank front surface has a convexed configuration between the side edges.

17. A trigger sprayer for dispensing liquid, said trigger sprayer comprising:

a housing;

a pump in the housing;

a fluid discharge passage in the housing and in fluid communication with the pump;

a trigger operatively connected with the pump for operation of the pump on manual manipulation of the trigger, the trigger having a shank with opposite top and bottom ends, opposite side edges, and opposite front and rear surfaces extending between the top and bottom ends and the side edges;

a connector at the top end of the shank, the connector being configured for mounting the trigger on the housing for movement of the trigger relative to the housing; and, the shank front surface having a width between the shank side edges that increases as the shank extends from adjacent its top end toward its bottom end.

18. The trigger sprayer of claim 17, wherein:

the shank has a plurality of finger engagement areas on the front surface arranged longitudinally between the shank top and bottom ends, and at least two of the finger engagement areas increase in size as the shank extends from its top and toward its bottom end.

19. The trigger sprayer of claim 17, wherein:

a section of the shank rear surface is configured for engaging with the pump to cause movement of the pump between fluid charge and fluid discharge positions of the pump in response to manual movement of the trigger relative to the housing.

20. The trigger sprayer of claim 17, wherein:

at least a portion of the shank front surface has a convexed configuration between the side edges.

* * * * *